US007589683B2

(12) United States Patent
McKivergan et al.

(10) Patent No.: US 7,589,683 B2
(45) Date of Patent: Sep. 15, 2009

(54) BROADBAND BLADE ANTENNA ASSEMBLY

(75) Inventors: Patrick D. McKivergan, Londonderry, NH (US); Court E. Rossman, Merrimack, NH (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 473 days.

(21) Appl. No.: 11/579,370

(22) PCT Filed: Jul. 20, 2005

(86) PCT No.: PCT/US2005/025621

§ 371 (c)(1),
(2), (4) Date: Dec. 7, 2006

(87) PCT Pub. No.: WO2006/130159

PCT Pub. Date: Dec. 7, 2006

(65) Prior Publication Data

US 2008/0278388 A1 Nov. 13, 2008

Related U.S. Application Data

(60) Provisional application No. 60/608,264, filed on Sep. 9, 2004.

(51) Int. Cl.
*H01Q 1/28* (2006.01)

(52) U.S. Cl. ..... 343/708; 343/705

(58) Field of Classification Search ..... 343/708, 343/705

See application file for complete search history.

(56) References Cited

U.S. PATENT DOCUMENTS

| | | | | |
|---|---|---|---|---|
| 3,453,628 | A | 7/1969 | Dolan | |
| 4,072,952 | A | 2/1978 | Demko | |
| 4,336,543 | A | 6/1982 | Ganz et al. | |
| 4,749,997 | A | 6/1988 | Canonico | |
| 4,912,477 | A * | 3/1990 | Lory et al. | 342/373 |
| 5,225,844 | A * | 7/1993 | Williams | 343/705 |
| 5,405,107 | A * | 4/1995 | Bruno | 244/117 R |
| 6,181,297 | B1 * | 1/2001 | Leisten | 343/895 |
| 6,208,304 | B1 | 3/2001 | Strickland | |

* cited by examiner

*Primary Examiner*—Trinh V Dinh
*Assistant Examiner*—Dieu Hien T Duong
(74) *Attorney, Agent, or Firm*—Daniel J. Long

(57) ABSTRACT

A lightweight broadband blade antenna assembly is incorporated into the surface of an airfoil, such as a structure component of an aircraft, or a separate airfoil (blade antenna) attached thereto. A first metallized area is formed on the airfoil adjacent a leading edge of the airfoil. A second metallized area is formed on trailing edge of the airfoil and is spaced from the first metallized area by a first gap which is configured to provide a capacitive coupling between the first and second metallized areas. A third metallized area is formed on the cap portion of the airfoil and is spaced from the first metallized area by a second gap and is electrically connected in series with the first and second metallized areas. RLC circuits are electrically connected across tuning gaps formed in the third metallized area to provide a broadband response.

18 Claims, 12 Drawing Sheets

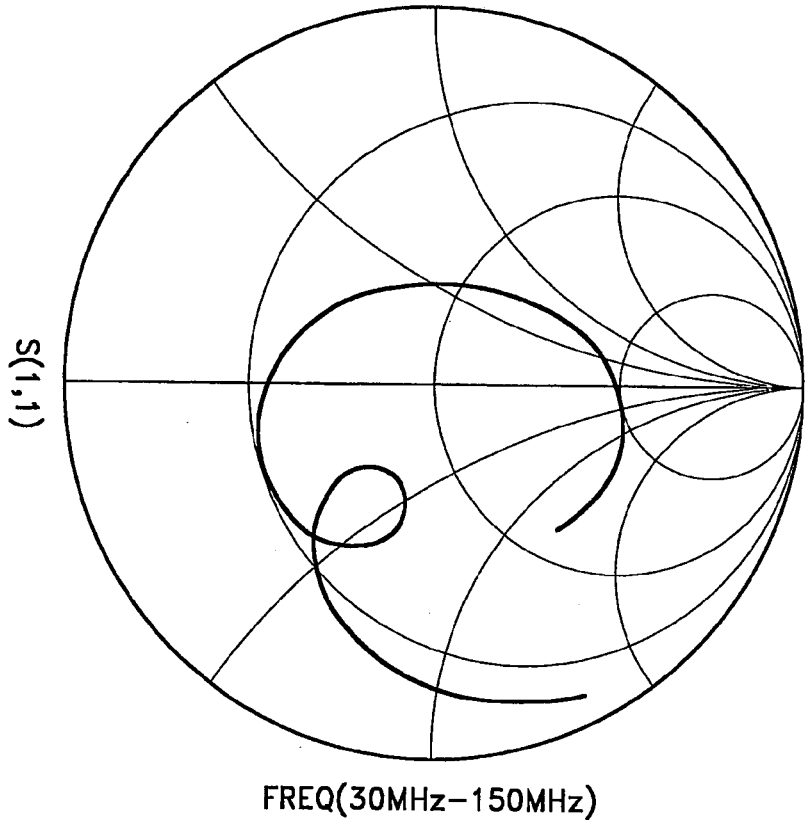
FIG–5
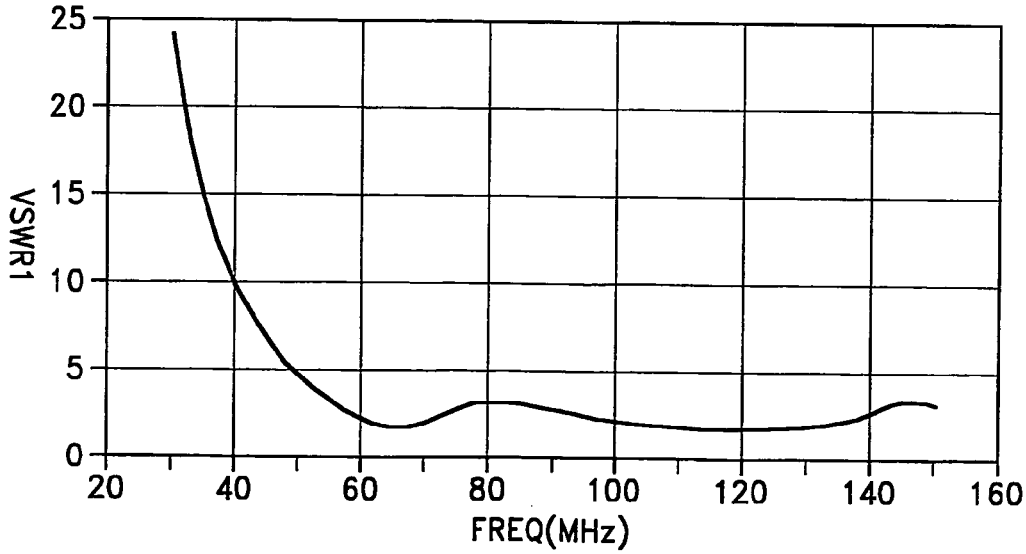

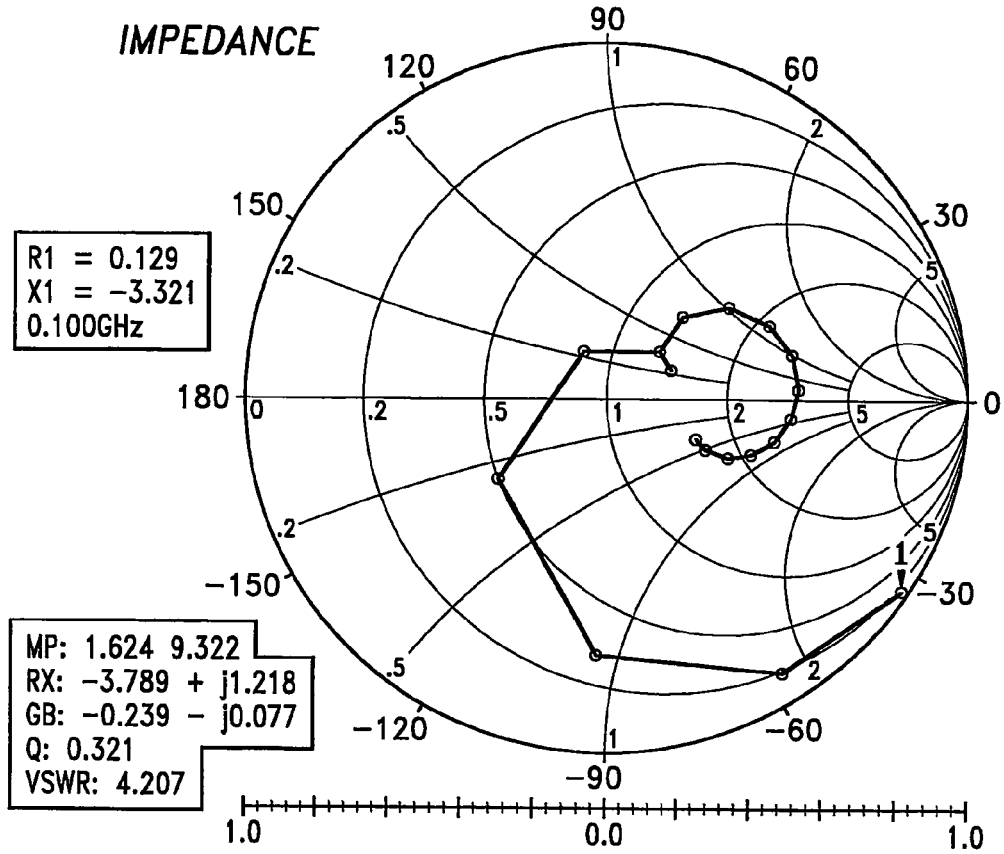
FIG-12
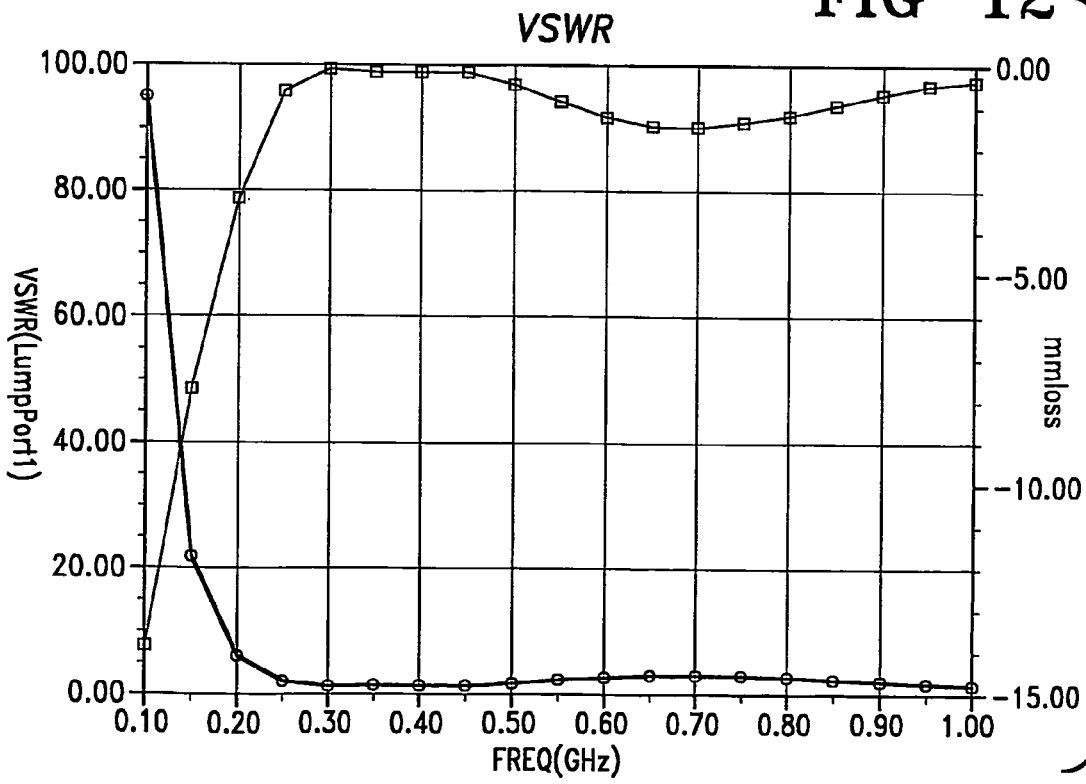

BROADBAND BLADE ANTENNA ASSEMBLY

CROSS REFERENCE TO RELATED APPLICATIONS

This application is a 371 of PCT US05/25621 filed Jul. 20, 2005.

This application claims rights under 35 USC 119(e) from U.S. application Ser. No. 60/608,264 filed Sep. 9, 2004, the contents of which are incorporated herein by reference.

STATEMENT OF GOVERNMENT INTEREST

This invention was made with U.S. Government support under Contract No. MDA972-00-9-0009 with Defense Advanced Research Project Agency (DARPA), and the U.S. Government has certain rights in the invention.

BACKGROUND OF THE INVENTION

1. Technical Field

The present invention relates to antennas and, more particularly, to broadband blade antennas. Even more particularly, the invention relates to an antenna which is formed by applying metallized surfaces to the surface of an airfoil in a specific pattern and in which three specific metallized areas are provided which are connected in series and provided with tuning components to provide for a tuned response.

2. Background Information

Airborne applications severely constrain the antenna design in terms of size/shape and weight. This problem is magnified for broadband applications. By using a nominal airfoil design as the basis for the antenna structure, the design becomes inherently suitable for the intended environment.

Typical blade antenna structures encase a radiating element in layers of glass or other support structure which form an airfoil to meet the airborne requirements. Typically, these blades are resistively loaded to control elevation lobing to avoid radiation nulls at the horizon.

The resistively tapered blade has two major limitations, (1) it does not improve the low-frequency match of the antenna and (2) the resistive taper is present electrically at all frequencies typically limiting the efficiency of the antenna to less than 50%. Additionally, due to construction techniques, the surface area of the radiating element can be relatively small compared to the surface area of the airfoil encasing it.

Also, it is a well known technique for electrically small wire monopoles, to provide inductance half way up the monopole, to draw current up the antenna and increase the radiation resistance. However, these wire antennas, which are typically used for CB radios, are narrow band.

There is, therefore, a need for an antenna which overcomes such limitations of the prior art.

BRIEF SUMMARY OF THE INVENTION

The present invention is an antenna which is integrated into the surface of an airfoil. By means of appropriate geometry features and reactive loading, a lightweight broadband omnidirectional antenna assembly is realized.

Another aspect of the present invention is the formation of three metallized areas on the surface of the airfoil such as by the use of a metallized foil, metallized paint, flexible circuit board bonded to the airfoil, or the like.

A further aspect of the present invention is to provide three separate metallized areas, the first of which extends about the leading edge of the airfoil with the second metallized area extending about the trailing edge of the airfoil and spaced from the ends of the first metallized areas forming gaps therebetween which provides a capacitive coupling across the gaps for achieving a tuned response. The third area extends over the cap of the airfoil and is spaced from and extends along the first metallized area and is electrically connected to the first metallized area at the leading edge of the airfoil and is electrically connected to the second metallized area at the trailing edge of the airfoil to place the three metallized areas in a series electrical relationship.

Still another feature of the invention is to form the third metallized area with one or more gaps or grooves across which can be mounted parallel RLC networks which are electrically connected across the third metallized area segments to provide broadband impedance matching of the antenna.

Another aspect of the invention is to provide a transmission line connection at the lower end of the leading edge of the airfoil for connection to radio frequency (RF) electronics, and in which the airfoil is mounted on a support surface which functions as the ground plane for the antenna.

Another feature of the invention is to provide the three metallized areas on the airfoil whereby the first and second metallized areas covering the leading and trailing edges of the airfoil provide a fixed design for the antenna with the third metallized area covering the cap portion of the airfoil, providing flexibility by enabling various tuning components to be incorporated therein to tune the antenna to achieve the desired antenna characteristics.

A further feature of the invention is to incorporate the metallized areas of the invention into either a monopole or dipole antenna.

Still another aspect of the invention is to provide an antenna in which the radiation pattern is omnidirectional for a first portion of the band and then transitions to a unidirectional behavior beyond said first portion because the metallized pattern creates a traveling-wave notch element at higher frequencies.

The foregoing advantages, construction and operation of the present invention will become more readily apparent from the following description and accompanying drawings.

BRIEF DESCRIPTION OF THE SEVERAL VIEWS OF THE DRAWINGS

The present invention is further described with reference to the accompanying drawings wherein:

FIG. 5 are graphs showing measured impedance and VSWR for the antenna shown in FIGS. 1 and 5;

FIG. 12 is a chart and a graph showing the broadband impedance match and VSWR of the traveling-wave antenna of FIG. 11;

Similar numbers refer to similar parts throughout the specification.

DETAILED DESCRIPTION OF THE INVENTION

Figure 1:
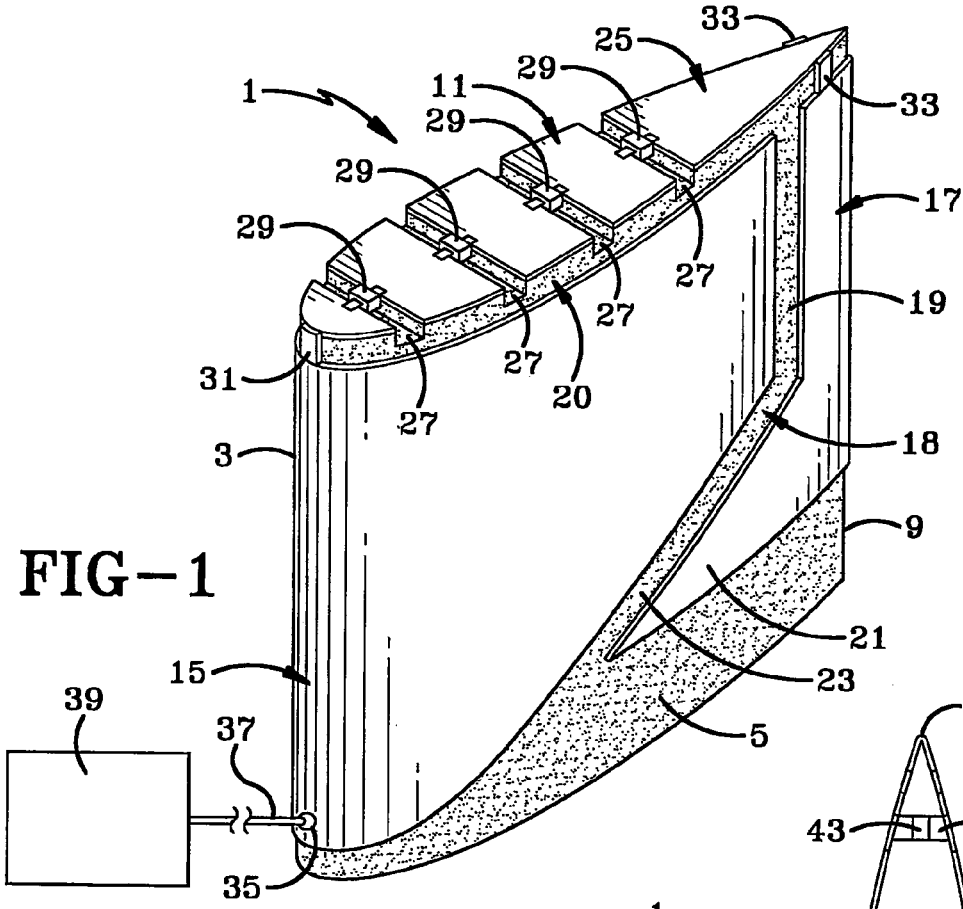
FIG. 1 is a side perspective view of a preferred embodiment of the antenna structure of the present invention.

A preferred embodiment of the invention is shown in FIG. 1 and is indicated generally at 1, and is an example of one type of airfoil in which the improved antenna can be incorporated. Airfoil 1 is of a usual construction having a leading edge 3 and side edges 5 which are tapered rearwardly toward a trailing edge 9, and which includes a generally teardrop-shaped cap end surface 11. Airfoil 1 is shown in FIG. 5 mounted on a conductive support surface 13 which will function as a ground plane for certain applications of the antenna when incorporated into airfoil 1. Airfoil 1 can be a self-standing blade antenna or can be a particular airfoil structure of an aircraft such as the wing, tail, rudder etc. Likewise, it could be an airfoil-shaped blade antenna mounted at various positions on the aircraft whereby support surface 13 would be that portion of the aircraft structure on which the antenna is mounted and extends outwardly therefrom.

In accordance with the invention, a first metallized area indicated generally at 15, is formed or mounted on airfoil 1 and extends about front leading edge 3 and rearwardly toward trailing edge 9, a distance generally more than one half of the longitudinal length of side surfaces 5. A second metallized area indicated generally at 17, extends about trailing edge 9 and forwardly along side surfaces 5 toward leading edge 9, a distance less than half of the longitudinal length of airfoil 1. Second metallized area 17 terminates before contacting first metallized area 15 and forms a gap indicated generally at 18. Gap 18 includes a pair of opposed, generally vertically extending gap sections 19, one on each side surface 5. Metallized area 17 preferably includes a triangular-shaped area 21 which extends forwardly toward leading edge 3 and is spaced from first metallized area 15 by an angularly extending gap section 23 which is a portion of gap 18 and merges into gap section 19 thereof.

Figure 1A:
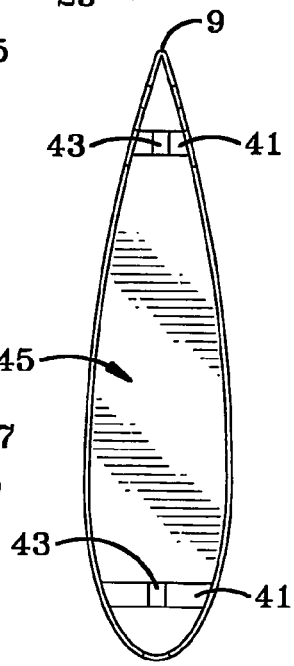
FIG. 1A is a top plan view of the airfoil of FIG. 1 showing a modified type of RLC circuit.

A third metallized area indicated generally at 25 is formed on airfoil cap surface 11 and preferably extends throughout the longitudinal and cross-sectional length of cap surface 11 as shown particularly in FIGS. 1 and 1A, and is spaced from first metallized area 15 by a gap 20.

In accordance with a first embodiment, metallized area 25 is formed with a plurality of tuning gaps or spaces 27, four of which are shown in FIG. 1 which extends completely across the cross-sectional width of metallized area 25. RLC circuitry, each of which is indicated generally at 29, is provided across each gap 27 in order to provide a tuned response at a significantly lower frequency than the natural resonance of the antenna and to provide a damping effect s thereto as discussed further below. Metallized area 25 is electrically connected to the first metallized area 15 at leading edge 3 by a connection 31 and is connected to the second metallized area 17 by one or more electrical connections 33 adjacent trailing edge 9. This places the three metallized area in an electrical series relationship. A connection 35 preferably formed at the lower end of front edge 3 of metallized area 15 to which is connected a transmission line 37 which extends to the appropriate transmit/receive equipment and associated components of an antenna system.

A slightly modified damping arrangement is shown in FIG. 1A wherein a single tuning gap or space 41 is provided, in a modified metallized area indicated at 45. Gap 41 is provided with electrical connections 43 extending across the gaps of the individual spaced areas of metallized area 45 to provide for a RLC circuit therebetween. The remaining features of the particular metallized area 45 shown in FIG. 1A is the same as that of metallized area 25 discussed above including its various connections to the first and second metallized areas 15 and 17.

In the present invention, the surface area of the airfoil is metallized with a specific pattern to achieve a reduction in the resonant frequency relative to the response of a uniformly metallized structure. In this way, the antenna surface area is maximized for a given airfoil. The geometry of the metallization yields a tuned response at a low frequency but suffers from an anti-resonant condition limiting its ability to achieve broadband gain and input match. By inserting a number of RLC sections on the top surface of the airfoil, this effect can be sufficiently damped. Alternatively, a lossy transmission-line can be used in place of the RLC circuit to provide damping. The relatively large surface area of the airfoil provides a good thermal sink for the high-power resistors in the case of high-power communications or electronic attack applications.

A 20" high×24" chord blade design was numerically modeled and reduced to practice. The structure is shown in FIGS. 1 and 4.

Figure 2:
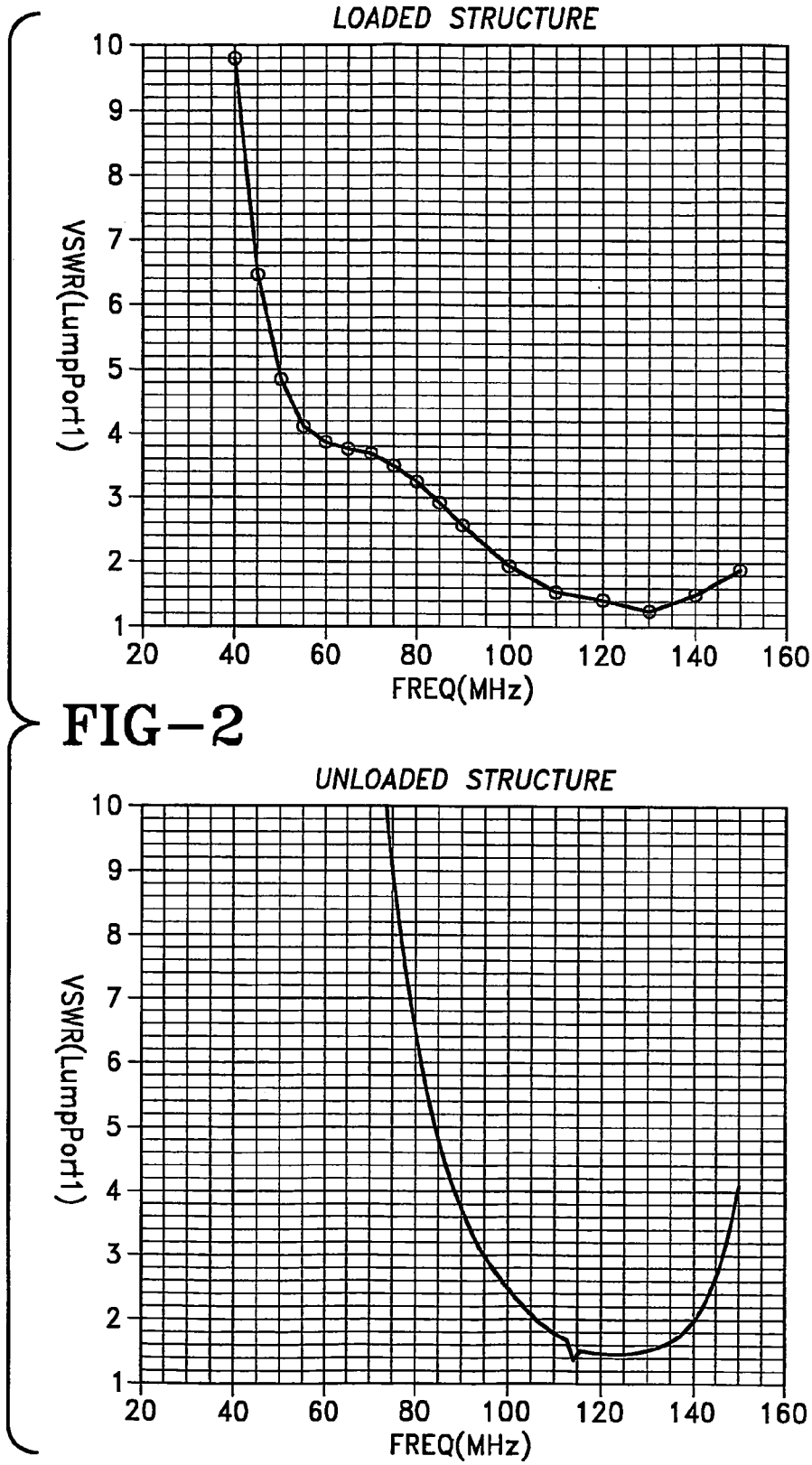
FIG. 2 are graphs showing VSWR for the antenna shown in FIG. 1.
Figure 3:
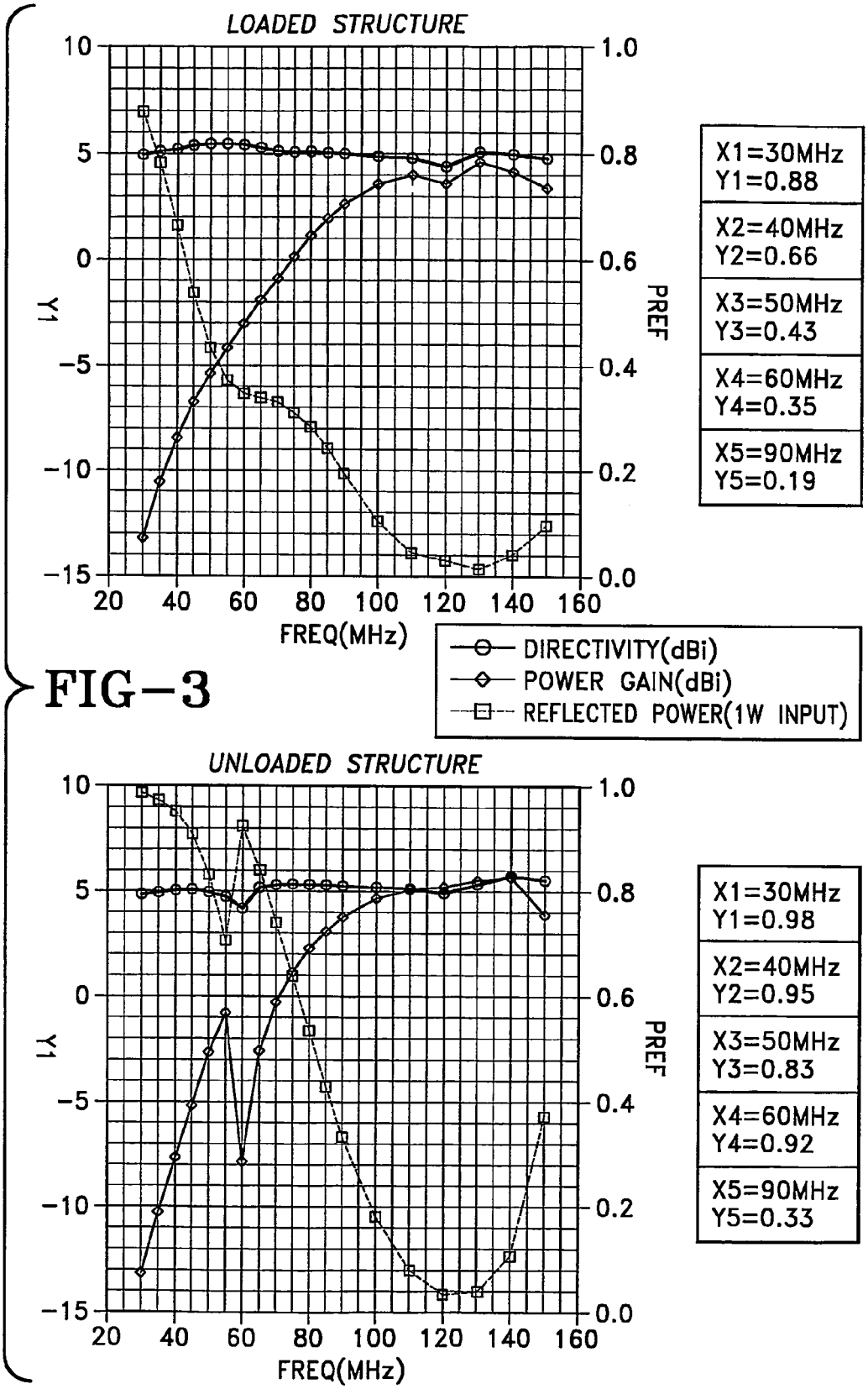
FIG. 3 are graphs showing gain, directivity and reflected power vs. frequency for the antenna shown in FIG. 1.

FIG. 2 shows the response of blade antenna 1 with and without loading. Note that the low-frequency is extended by 50%. The unloaded structure exhibits a narrowband series resonant behavior at about 55 MHz followed by an ant-resonance at 60 MHz. Thus the gain has a spike at the tuned frequency but does not exhibit a broadband nature. Additionally, the VSWR is high below 80 MHz which would require an external matching circuit or an isolator. The gain, directivity and reflected power vs. frequency is shown in FIG. 3. The loaded structure presents much less reflected power to the power amplifier while maintaining good broadband gain.

Figure 4:
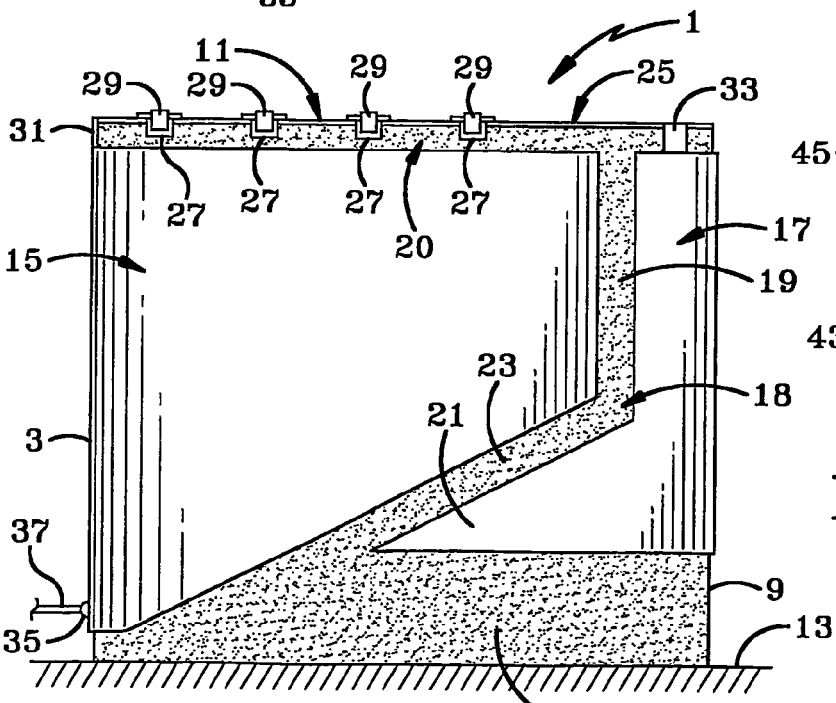
FIG. 4 is a side elevational view of a first embodiment of the antenna of the present application.
Figure 6:
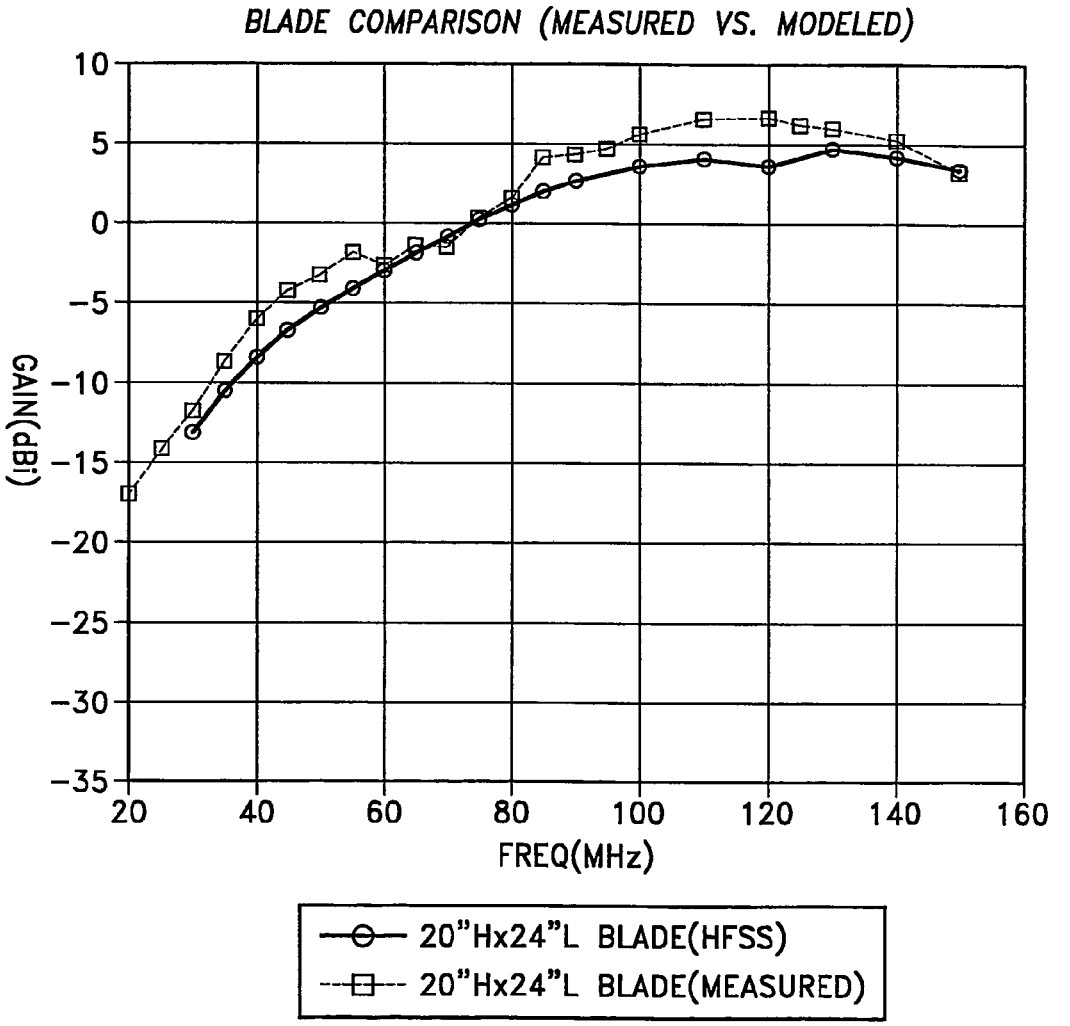
FIG. 6 is a graph showing measured and modeled gain for the antenna shown in FIGS. 1 and 5.

For the prototype antenna as is shown in FIGS. 1 and 4, the measured impedance and VSWR is shown in FIG. 5. Measured gain along with predicted gain from simulation tools is shown in FIG. 6.

Those skilled in the art will appreciate that the antenna of the present invention utilizes the surface area of the airfoil for the antenna in order to maximize radiation efficiency and provides broadband omni-directional radiation in excess of a 5:1 bandwidth with a good VSWR. Good VSWR performance can eliminate the need for a circulator or isolator stage between the power amplifier and the antenna thereby reducing system complexity, cost and weight.

Figure 7:
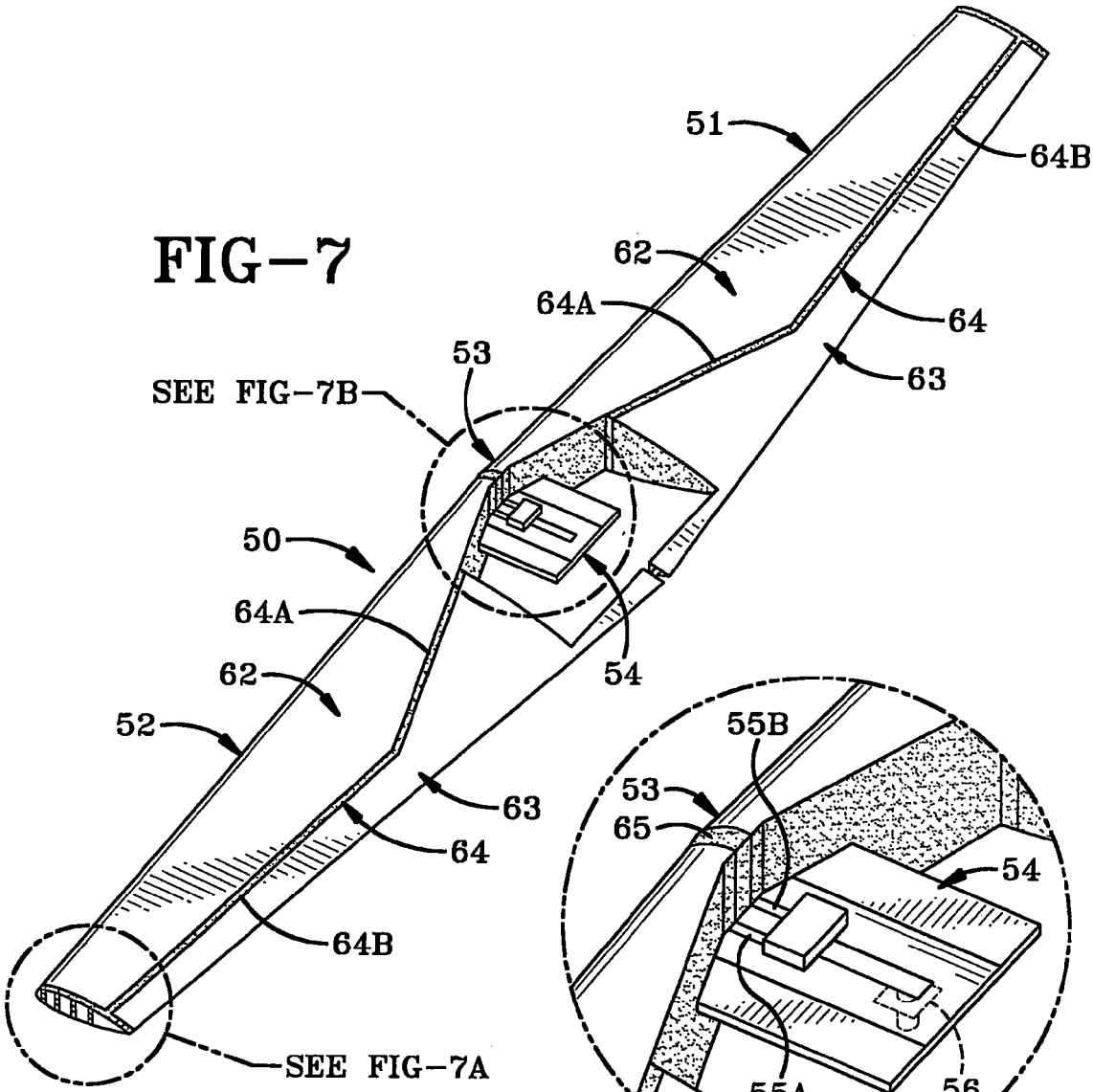
FIG. 7 is a diagrammatic perspective view of a second embodiment of the antenna structure of the present invention.

The unique features of the present invention can be incorporated into a monopole antenna as shown in FIGS. 1-6 and described above, as well as in a dipole antenna as shown in FIGS. 7-10 and described briefly below. FIG. 7 shows a dipole antenna indicated generally at 50, which includes two generally similar half-sections indicated at 51 and 52, which are connected at its central area 53 to a feed board assembly indicated generally at 54. Assembly 54 includes a pair of micro strip feed lines 55A and 55B, each of which is connected to a respective member 51 and 52 of the dipole antenna 50, and which includes a 4:1 matching balun 56.

Figure 7B:
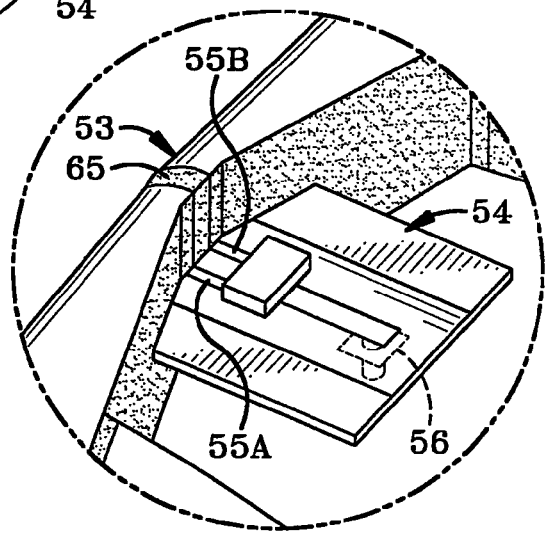
FIG. 7B is an enlarged fragmentary view of another encircled portion of FIG. 7.
Figure 7A:
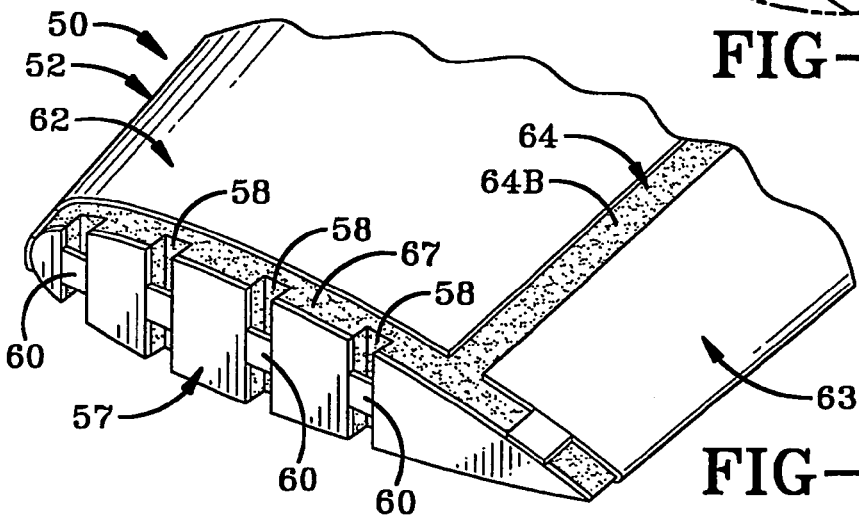
FIG. 7A is an enlarged view of one of the encircled portions of FIG. 7.
Figure 9:
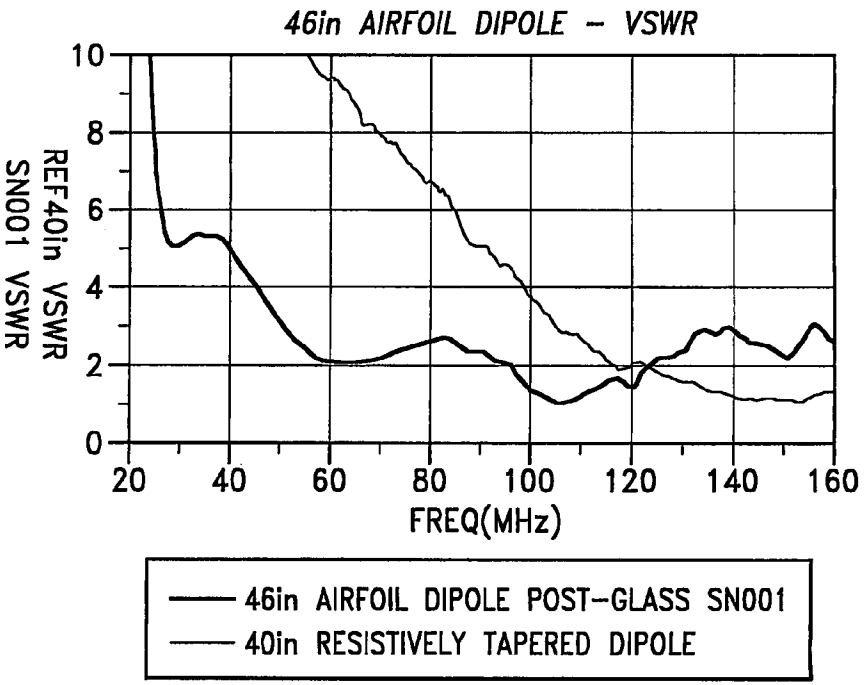
FIG. 9 is a graph showing the VSWR of a 46 inch dipole antenna and a 40 inch dipole antenna similar to that shown in FIG. 7.

FIG. 7A shows the third metallized area 57 provided at the cap of the airfoil being formed with multiple gaps 58 for receiving RLC circuits indicated generally at 60, which are similar to that shown at 29 in FIGS. 1 and 1A. Each dipole section 51 and 52 will have the first metallized area 62 extending about the leading edge of the air foil and second metallized area 63 extending about the trailing edge of the airfoil and spaced from the first metallized area by gaps 64. Each gap 64 will include an angularly extending section 64A and a generally linear section 64B. Gap sections 64B extend generally parallel to the leading edge of the airfoil and angular gap sections 64A extend in opposite outward directions from adjacent feed assembly 54. Each antenna section 51 and 52 is separated by a gap 65 as shown in FIG. 7B. Each cap portion of the airfoil is covered with the metallized area 57 and separated from metallized area 62 and 63 by a gap 67 as shown in FIG. 7A.

Figure 8:
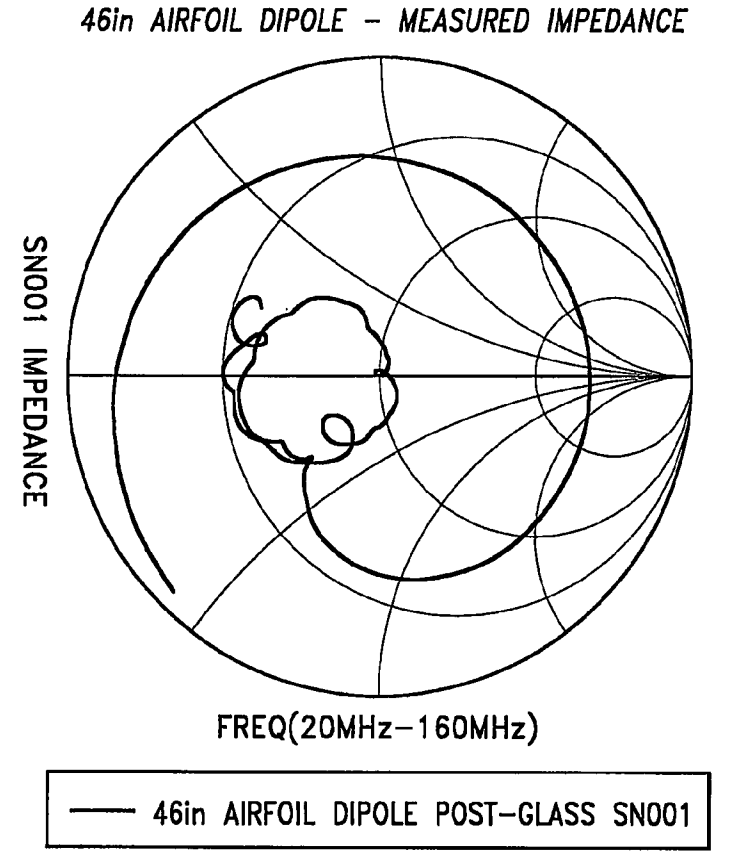
FIG. 8 is a plot showing the measured impedance of the antenna shown in FIG. 7.
Figure 10:
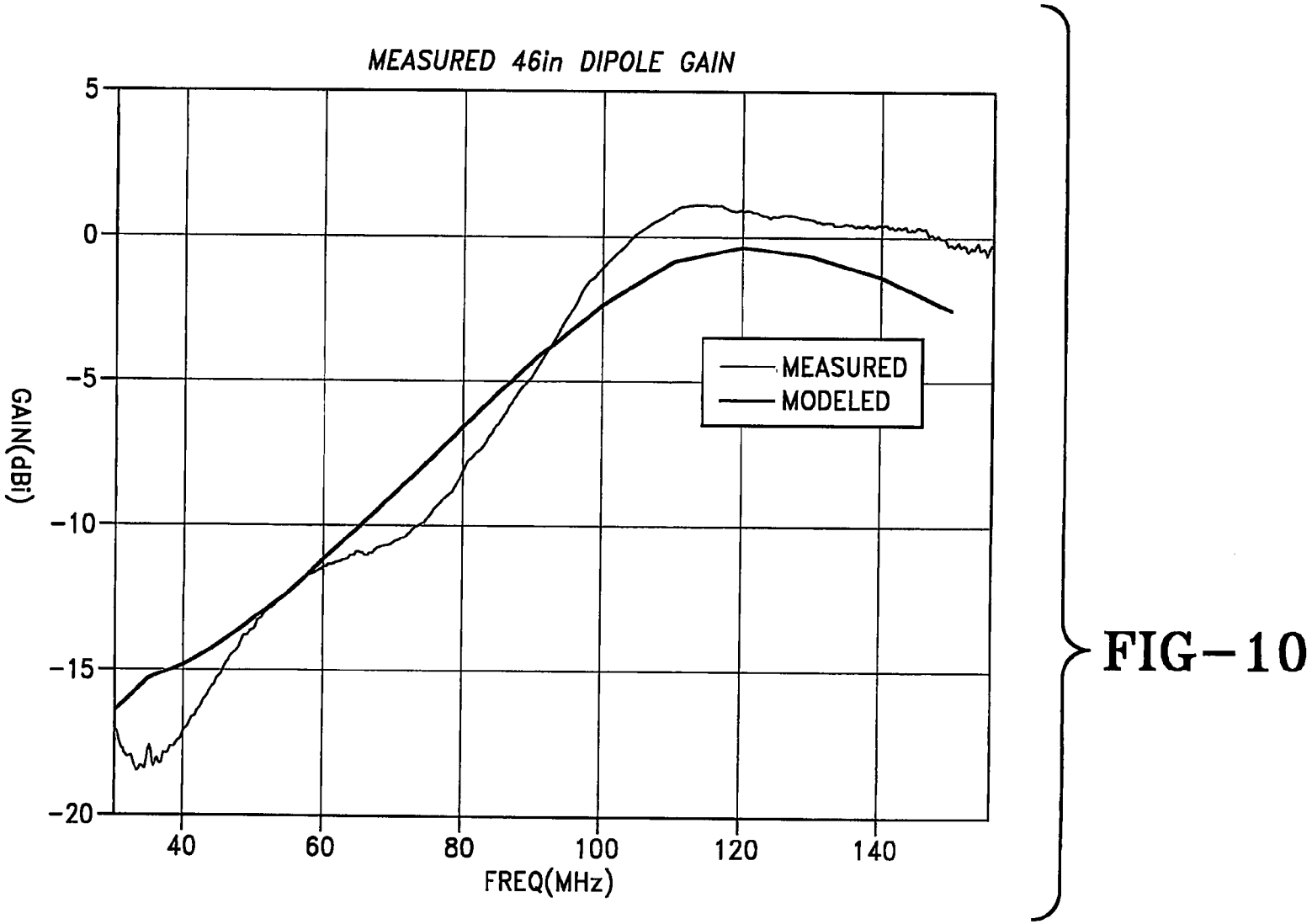
FIG. 10 is a graph showing the measured and modeled gain for the antenna shown in FIG. 7.

The operation and features of the dipole antenna 50 are similar to that described above for the monopole antenna of airfoil 1. The measured impedance of a 46 inch longitudinal length airfoil dipole is shown in FIG. 8 with the measured VSWR being shown in FIG. 9 for both a 46 inch and a 40 inch dipole having a configuration similar to that shown in FIG. 7. FIG. 10 shows the test results (measured) gain of the 46 inch dipole compared to the computer model results for such a dipole antenna according to the present invention, showing that the measured results are very comparable to that of the computer-modeled results. Each half section 51 and 52, in the preferred embodiment for a 46 inch tapered dipole as shown in FIG. 7, will have a base chord of 6 inches and a top chord of 3 inches. Such an antenna will have an operation frequency range from 30 to 150 MHz.

It will also be appreciated that the various embodiments of the antenna of the present invention have the following additional advantages and capabilities.

The antenna provides efficient broadband radiation from an electrically short antenna structure that meets airborne requirements such as air drag, side-load pressure and weight The design is applicable to high-power applications (5 KW or more) due the construction technique and the fact that it is amenable to RAM air cooling.

Relative to a standard resistively tapered blade, the antenna provides improves efficiency at the high end of the band and improves the input match at the low-end of the band. The improved match can eliminate the need for isolator/circulators or external matching circuits saving weight and system complexity.

The antenna can be configured to operate in an agile tuned mode if desired to improve narrowband gain at low frequencies.

The antenna can be designed on an arbitrary airfoil and is therefore suitable for integration directly into an airframe.

Given the embodiment disclosed in FIG. 4, the antenna impedance behavior remains well matched over a greater than 10:1 bandwidth. The radiation pattern is omnidirectional over the first 5:1 band and transitions to a unidirectional behavior above that. This unidirectional pattern results in increased gain in a given direction and may be useful for applications which require sectorized coverage. This behavior is a result of the shape of the leading edge metallization creating a traveling-wave "notch" element at high frequencies which results in the broadband unidirectional patterns.

Figure 11:
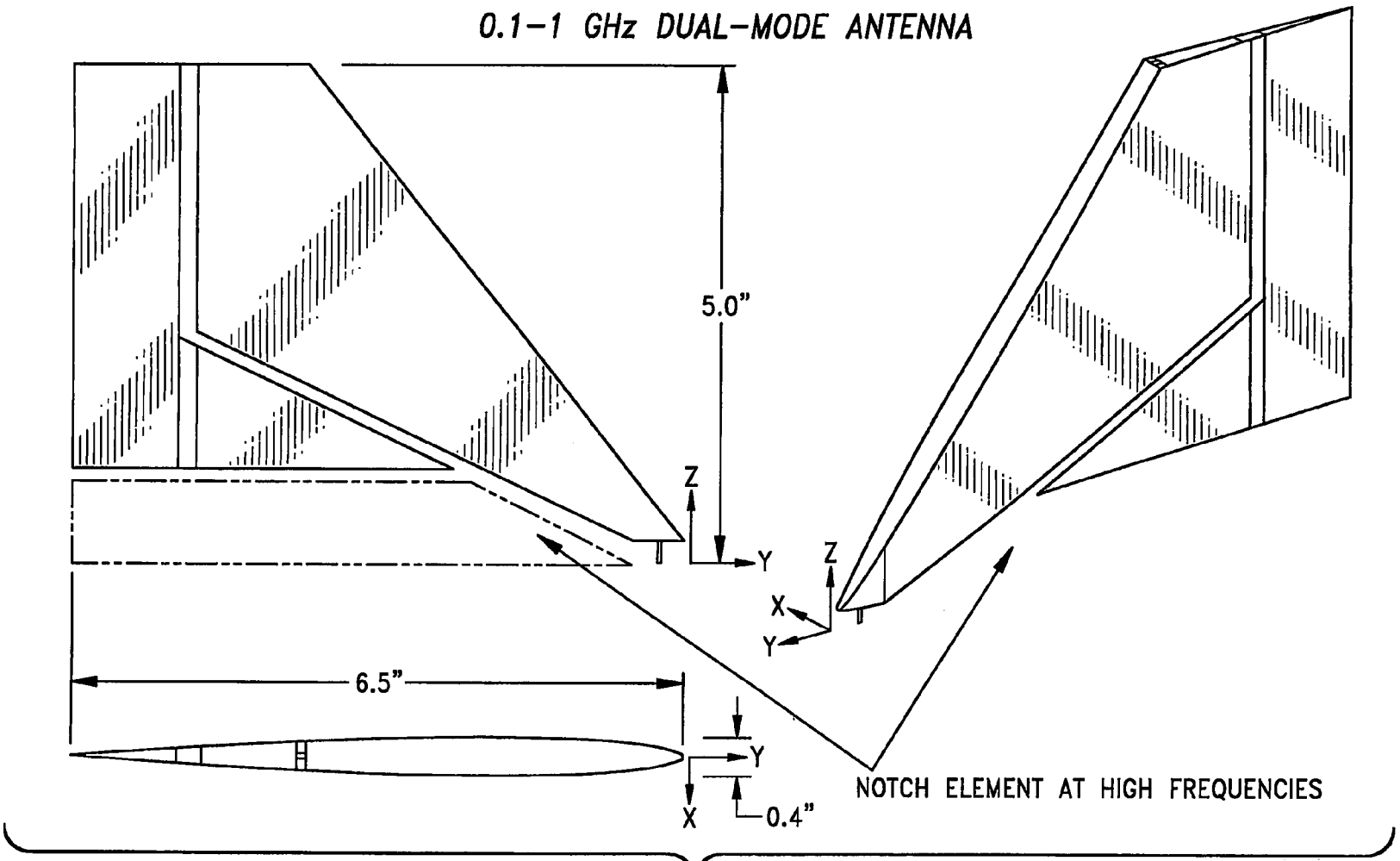
FIG. 11 are diagrammatic views of a sample blade antenna containing the metallized pattern for creating a traveling-wave notch element at high frequencies.
Figure 13:
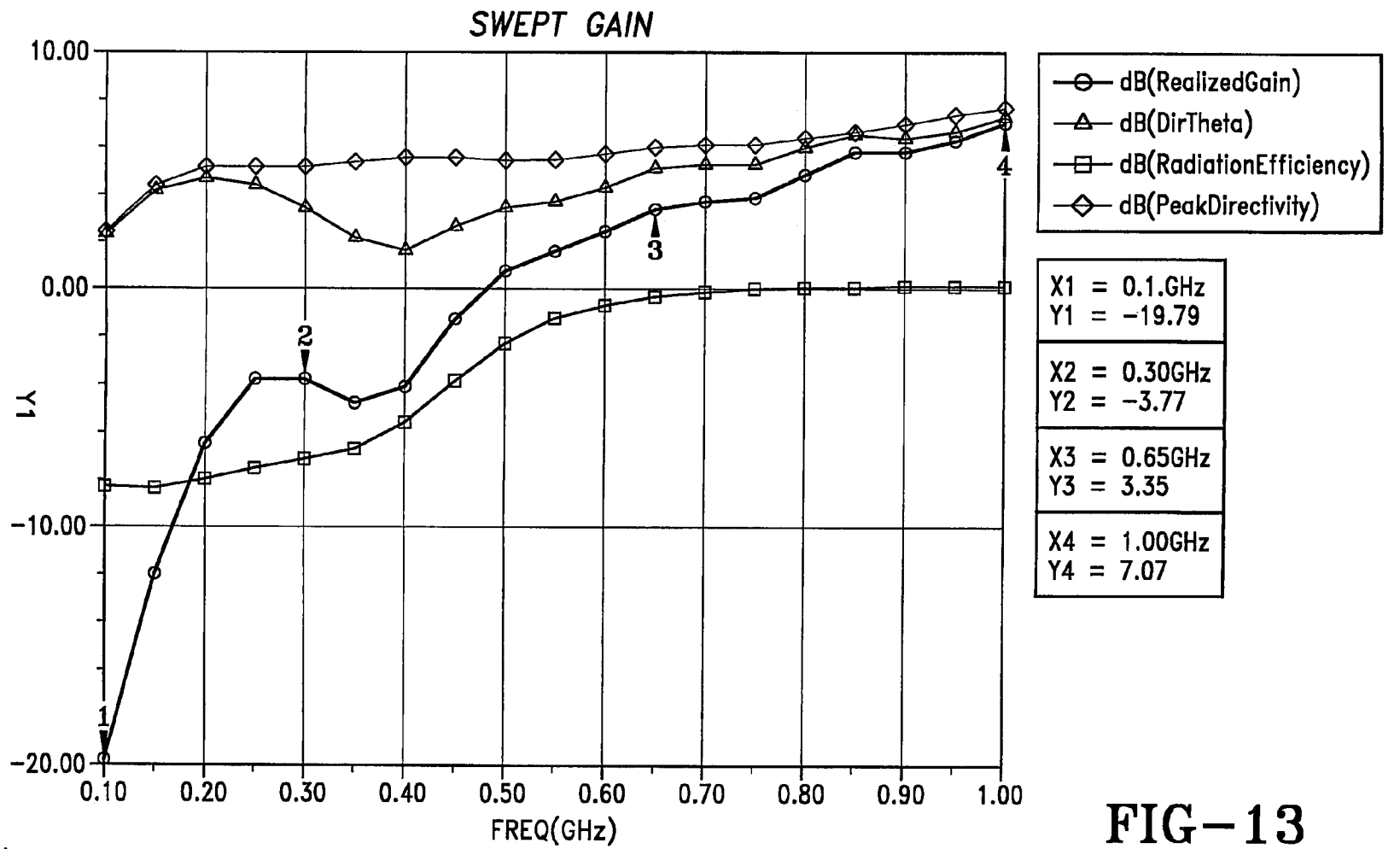
FIG. 13 is a chart showing the swept gain of the traveling-wave antenna of FIG. 11.
Figure 14:
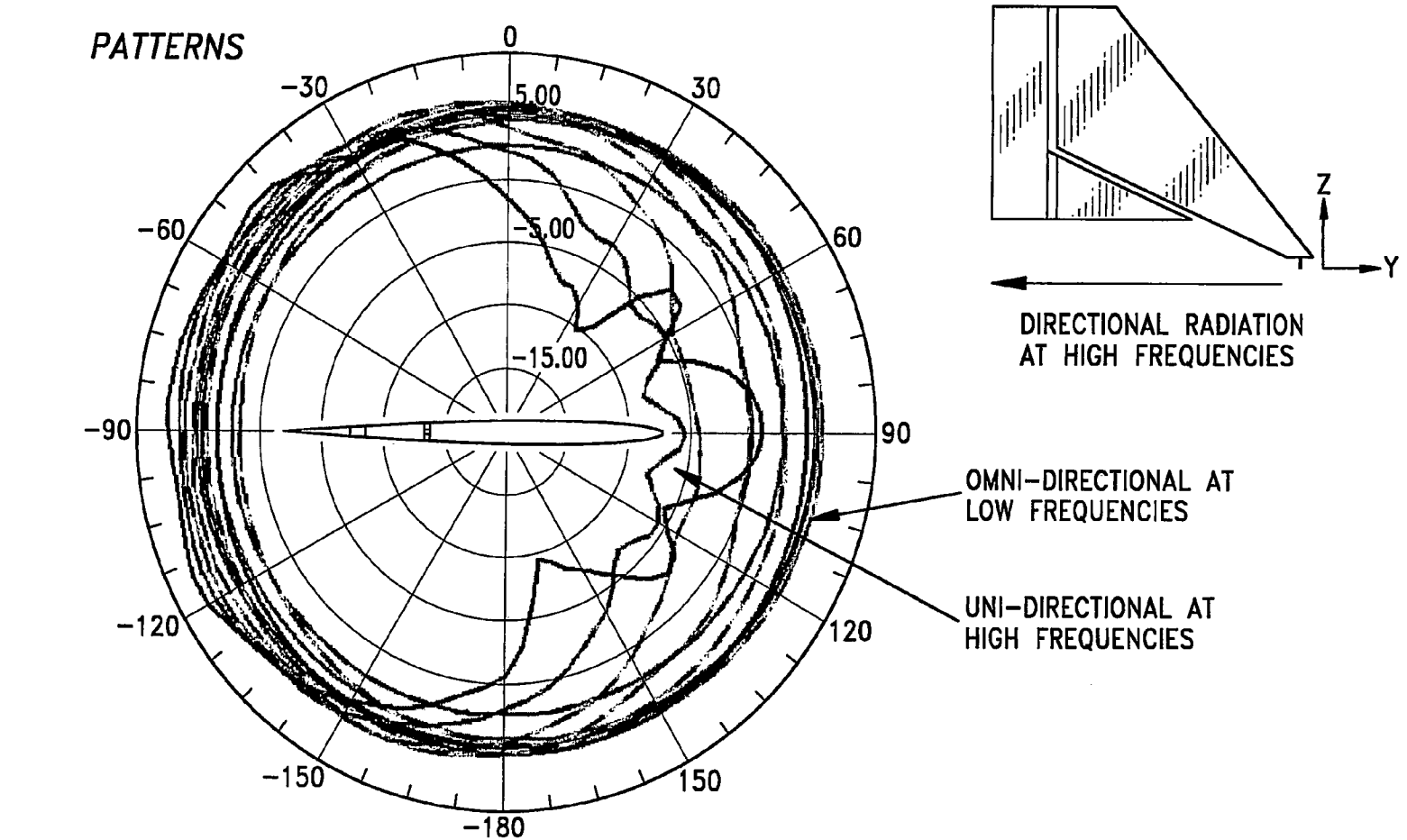
FIG. 14 is a chart showing the pattern transitions from an omni monopole mode to a directional notch mode for the antenna of FIG. 11.

This feature and results are shown for a prototype antenna having the shape and size as shown in FIG. 11 which contains the metallized pattern as shown for the antenna of FIG. 4 and described above. The broadband impedance match which is indicative for traveling-wave antenna, and the VSWR plot of FIG. 12 shows the transition between omnidirectional to unidirectional, with the swept gain being shown in the plot of FIG. 13. The pattern transitions from the omni monopole mode to the directional notch mode of this antenna is shown by the graph of FIG. 14.

The angle of the notch as well as the length, curvature, etc. can vary without affecting the concept of the invention but will change the characteristics of the antenna while still providing the smooth transition from omnidirectional to unidirectional. In the antenna example of FIG. 11, it has been found that a height "H" of the metallized area above the ground plane which is approximately equal to or greater than 0.10 wavelength will start to change the radiation pattern from omnidirectional to unidirectional.

The various frequency responses of the antenna can be classified into two regions as follows:

At the lower frequencies, the antenna is resonant, and loaded with extra L and C due to the shape and due to L and Cs placed on the top of the antenna. This resonance is damped using a loss mechanism, in order to achieve broad band matching. At the higher frequencies, the base of the antenna forms a broadband traveling wave monocone, or a traveling wave "notch" element, independent of the top structure.

At the lowest frequencies the dominant response of the antenna is reactive, due to the low radiation resistance. Low radiation resistance, and the consequent degraded radiation efficiency, is a standard issue for electrically small antennas. The antenna forms an inductive/capacitive (LC) reactance: an initial inductive hook, with enhanced LC reactance on the top surface, and a series capacitance to ground at the bottom of the inductive hook.

Compared to a standard resistively tapered monopole or wedge, this hook causes more inductance and path length, and also causes larger capacitance to ground at the end of the hook. The enhanced L and C provide a lower tuned frequency response.

At the LC loaded resonance of the antenna, the antenna is electrically a short wire hook connected to a capacitor to ground. The antenna is less than a tenth of a wavelength high. Tuning is achieved due to the reactive LC cancellation. The current is larger flowing up the initial feed/base (metal 1) of the antenna, compared to the current flowing down the capacitive far end of the antenna (final metal 3). Hence radiation occurs.

There is a trade-off between improved match versus radiation resistance at the low resonance frequency. Improved match occurs at this low resonance frequency, due to the LC reactive cancellation, resulting in improved radiated power, regardless of the radiation resistance. The trade-off is that, this smaller opposite current down the capacitive final end partially reduces the radiation resistance at these very low frequencies.

Damping of the resonance is necessary for the following reason. At a frequency just above the LC loaded resonance, a large anti-resonance or mismatch can occur. More power radiates at the frequency of the anti-resonance when the top reactance is damped, and a perfect mismatch is avoided. One interpretation is that this anti-resonance is due to in-phase reflections from various parts of the antenna. One reflection is due to the top reactive loading. A second reflection is due to the capacitive end of the antenna. A third influence might be the shunt capacitance between the $1^{st}$ and $3^{rd}$ metal pieces, which may provide a parallel current path to the top reactance. These reflections add in phase and create an anti-resonance. If instantaneous bandwidth is desired, reflections should be dampened with a loss mechanism in the top reactive loading.

This loss mechanism is de-emphasized or by-passed at the higher frequencies, when the capacitance between the $1^{st}$ and $3^{rd}$ metal acts as a shunt capacitance to short out the top damped reactance. Hence close to 100% radiation efficiency is possible at the higher frequencies.

At the higher frequencies, the radiation is strong at the base of the antenna, due to the wedge shape. Much of the current radiates in the bottom quarter wave of the antenna. Any current that does reach the top is partially dampened in the loss of the LCR tuning components. The very base of the antenna can be shaped as a notch or a wedge. Using a notch, the patterns can be designed to be directional. Using a symmetrical wedge, the patterns are designed to be more symmetrical, i.e., the pattern would be more omni-directional or bi-directional.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

The invention claimed is:

1. An antenna integrated into the surfaces of an airfoil structure having a leading edge and opposed side surfaces tapered rearwardly toward a trailing edge comprising:

a first metallized area extending about the a leading edge of the airfoil and along a majority portion of the side surfaces of said airfoil;

a second metallized area extending about the a trailing edge of the airfoil and along a minority portion of the side surfaces and spaced from said first metallized area by a first gap, said first gap being configured to provide a capacitive coupling between said first and second metallized areas; and a third metallized area disposed on a cap portion of the airfoil and spaced from said first metallized area by a second gap and electrically connected in series with said first and second metallized areas and formed with at least one tuning gap extending between the opposed side surfaces.

2. The antenna defined in claim 1 wherein the second metallized area forms a pair of first gaps between said first and second metallized areas.

3. The antenna defined in claim 1 wherein an RLC circuit is electrically connected across the tuning gap of the third metallized area to provide broadband impedance response.

4. The antenna defined in claim 1 wherein the metallized areas are provided by a metal foil laminated on the airfoil.

5. The antenna defined in claim 1 wherein the metallized areas are provided by a metal paint applied to the airfoil.

6. The antenna defined in claim 1 wherein the first and third metallized areas are electrically connected in series adjacent the junction of the cap portion and leading edge of the airfoil.

7. The antenna defined in claim 6 wherein the second and third metallized areas are electrically connected in series adjacent the junction of the cap portion and trailing edge of the airfoil.

8. The antenna defined in claim 6 wherein the first metallized area includes a connection for electrically connecting the three metallized areas to an electrical transmission line.

9. The antenna defined in claim 8 wherein the connection is located adjacent the leading edge of the airfoil adjacent a support surface which provides a ground plane for the antenna.

10. The antenna defined in claim 1 in which the airfoil is operationally connected to a ground plane, and wherein the first metallized area has an edge which is tapered from the leading edge of the airfoil toward the trailing edge away from the ground plane.

11. The antenna defined in claim 10 in which the first gap includes a first section which extends generally perpendicularly from adjacent the third metallized area toward the ground plane.

12. The antenna defined in claim 11 wherein the first section of the first gap connects with a second gap section which extends in an angular direction toward the ground plane.

13. The antenna defined in claim 1 in which the antenna is a monopole antenna.

14. The antenna defined in claim 1 in which the antenna is a dipole antenna.

15. The antenna defined in claim 1 in which the antenna includes two substantially similar antenna sections, each section containing the three metallized areas connected to a feed assembly to form a dipole antenna.

16. The antenna defined in claim 15 in which the first gap of each of the metallized areas includes a first section angularly extending with respect to the leading edge of the airfoil and a second section extending generally parallel with said leading edge; and in which the angularly extending sections extend in substantially opposite directions to each other from the feed assembly.

17. The antenna defined in claim 15 in which the feed assembly includes a 4:1 balun transformer.

18. The antenna defined in claim 1 wherein the first gap is angularly extending with regard to the leading edge of the airfoil and creates a traveling-wave notch element at higher frequencies to provide broadband unidirectional radiation patterns.

* * * * *